US007395948B2

(12) United States Patent
Kogan

(10) Patent No.: US 7,395,948 B2
(45) Date of Patent: Jul. 8, 2008

(54) MULTIPLE TANK FLUID PUMPING SYSTEM USING A SINGLE PUMP

(75) Inventor: Meir Kogan, Maalot Tarshiha (IL)

(73) Assignee: Rafael Advanced Defense Systems Ltd., Maifa (IL)

( * ) Notice: Subject to any disclaimer, the term of this patent is extended or adjusted under 35 U.S.C. 154(b) by 655 days.

(21) Appl. No.: 10/938,656

(22) Filed: Sep. 13, 2004

(65) Prior Publication Data

US 2005/0058557 A1 Mar. 17, 2005

(30) Foreign Application Priority Data

Sep. 17, 2003 (IL) ..... 157977

(51) Int. Cl.
*B67D 5/52* (2006.01)

(52) U.S. Cl. ..... 222/136; 222/1; 222/145.1; 222/145.5; 222/145.6; 222/413; 222/138; 418/15; 418/206.5

(58) Field of Classification Search ..... 222/135–137, 222/132, 145.1, 145.5, 413, 145.6, 256, 260–261, 222/1; 418/206.4, 15, 206.1, 206.5
See application file for complete search history.

(56) References Cited

U.S. PATENT DOCUMENTS 1,673,262 A * 6/1928 Meston et al. ..... 418/84
1,902,346 A * 3/1933 Vogt ..... 418/15
2,161,861 A 6/1939 Gerlough
2,301,496 A 11/1942 Aldrich
3,080,819 A 3/1963 Mayes
3,242,867 A 3/1966 Mosbacher
3,420,180 A 1/1969 Behrends et al.
3,824,041 A * 7/1974 Rystrom ..... 417/310
4,093,407 A 6/1978 Miles
4,631,009 A * 12/1986 Cygnor et al. ..... 418/15
6,283,734 B1 * 9/2001 Blume ..... 418/1
6,312,240 B1 * 11/2001 Weinbrecht ..... 418/180
6,386,396 B1 * 5/2002 Strecker ..... 222/261
6,691,895 B2 * 2/2004 Strecker ..... 222/145.1
6,935,534 B2 * 8/2005 Strecker ..... 222/145.1

FOREIGN PATENT DOCUMENTS

GB 2161861 1/1986

* cited by examiner

*Primary Examiner*—Frederick C. Nicolas
(74) *Attorney, Agent, or Firm*—Mark M. Friedman

(57) ABSTRACT

Disclosed is a system for pumping of fluid by a single pump from a plurality of storage tanks in situations where some of the tanks should be pumped simultaneously at predefined, equal or unequal flow rates, and where some of the tanks should be pumped sequentially, in an orderly manner. The system needs no restrictors or valves to determine the flow rate or the sequence of pumping. In some embodiments, the rate of flow out of the pump does not change when one tank becomes empty before another.

8 Claims, 6 Drawing Sheets

MULTIPLE TANK FLUID PUMPING SYSTEM USING A SINGLE PUMP

FIELD AND BACKGROUND OF THE INVENTION

The present invention relates to a system for pumping fluid from multiple storage tanks and, in particular, it concerns a system for sequentially pumping fluid from multiple storage tanks using a single pump.

Various systems for pumping liquids from multiple sources to a single end point are known in the art. These include the use of separate pumps for each source, and a single pump coupled with separate on-off valves, or flow restrictors, associated with each source. Systems utilizing separate pumps suffer from extra cost and weight, along with the complexity of monitoring and actuating each pump when appropriate, especially if trying to synchronize the pumping rate so as to empty each of the tanks at substantially the same time. The issues of weight, monitoring and actuating is also true for systems using on-off valves to control the source of liquid flowing to the pump. Although flow restrictors do not allow for sequential emptying of a plurality of storage tanks, they provide a way to drain tanks of different volumes at different rates such that all of the tanks become empty at substantially the same time. When used with some liquids, such as aircraft fuel, these systems may create enough of a pressure drop after the flow restrictor to cause the fuel to vaporize in the fuel line before reaching the pump. Some of these systems are used in aircraft with the intention of pumping fuel from multiple fuel tanks located throughout the aircraft while maintaining the equilibrium of the aircraft.

It is known to provide gear pumps with multiple supply ports which supply liquid to the pump gears. The auxiliary supply ports of U.S. Pat. No. 3,083,819 to Mayes are configured as back-up or supplementary supply ports in case no, or insufficient, fuel is supplied to the pressurized primary supply port by a secondary pump located up stream from the main pump. All of the supply ports of Mayes receive fuel from a single tank. The injection port of Miles, U.S. Pat. No. 4,093,407, is configured to supply a limited quantity of a first liquid that will be mixed with a second liquid introduced at the primary supply port. During operation of the Miles pump the flow rate of the injected liquid is independent of the liquid flow rate caused by the gears of the pump. This requires additional flow control dedicated to the injection process. The liquids supplied to both ports are under pressure and both ports introduce liquids to the pumping gears during operation of the pump. U.S. Pat. No. 2,301,496, to Aldrich, discloses a gear pump in which liquid is introduced to the gear pump via a first supply port that is connected to a pressure release valve, such that liquid pumped out of the pump is reintroduced at the first supply port. Voids in the pumping volume of one of the gears, after the gear has passed the first supply port, are filled by liquid from the tank introduced by a second supply port that is connected to fuel tank. Therefore, the Aldrich system is essentially a circulation pump with a refill port that replaces any liquid lost from the system. The gear pump of U.S. Pat. No. 3,420,180, to Behrends et al., receives fluid from two sources, and includes a ratio-change passageway that provides a desired ratio of flow from the two sources. This arrangement is fine for a pump with only two supply ports connected to two different sources, it would, however, be inoperable in systems sequentially pumping from multiple tanks at different rates. The ratio-change passageway is also a problem for use with volatile liquids such as fuel where the pressure drop created in the passageway may cause the liquid to cavitate The gear pumps of prior art cited above include multiple supply ports all of which are configured to supply fluid to the gears of a gear pump at all times during the operation of the pump with no consideration for sequential pumping from multiple sources. It should be noted that none of the above referenced prior art addresses a configuration whereby liquid is pumped from two or more tanks at different predefined flow rates by a single pump in such a way that there is no restriction likely to give rise to cavitation of the liquid being pumped.

There is therefore a need for a system for sequentially and/or parallel pumping of fluid from multiple storage tanks, without causing cavitation of the liquid, utilizing a single pump having multiple supply ports. It would be beneficial if the system also provide for pumping from different tanks at different predefined flow rates. It would be of further benefit if the system were configured so as to maintain the equilibrium of the platform on which the storage tanks are deployed.

SUMMARY OF THE INVENTION

The present invention is a system for sequentially pumping fluid from multiple storage tanks utilizing a single pump having multiple supply ports According to the teachings of the present invention there is provided, a system for pumping a liquid from multiple storage tanks, the system comprising: (a) a rotor pump having: (i) a pump housing; (ii) at least two inter-engaged rotor elements deployed within the pump housing, each of the rotor elements having a plurality of successively inter-engaging projections, such that a dynamic seal is formed between walls of the pump housing and inter-engaged ones of the projections; (iii) at least two liquid supply ports configured such that one of the at least two liquid supply ports supplies liquid to one of the rotor elements and another one of the at least two liquid supply ports supplies liquid to another one of the rotor elements; and (iv) an outlet for flow of liquid out of the pump housing; (b) a first liquid storage tank in fluid communication with the first supply port; and (c) a second liquid storage tank in fluid communication with the second supply port; wherein liquid is pumped by the first rotor element from the first storage tank and liquid is simultaneously pumped by the second rotor element from the second storage tank.

According to a further teaching of the present invention the first inter-projection volume and the second inter-projection volume are different.

There is also provided according to the teachings of the present invention a method for simultaneously pumping a liquid from multiple storage tanks so as to draw liquid from each tank at a predefined ratio of flow rates, the method comprising: (a) providing a rotor pump having: (i) a pump housing; (ii) at least two inter-engaged rotor elements deployed with in the pump housing, each of the rotor elements having a plurality of successively inter-engaging projections, such that a dynamic seal is formed between walls of the pump housing and inter-engaged ones of the projections; and (iii) at least two liquid supply ports configured such that one of the at least two liquid supply ports supplies liquid to at least one of the rotor elements and another one of the at least two liquid supply ports supplies liquid to at least another one of the rotor elements; and (iv) an outlet for flow of liquid out of the pump housing; (b) establishing fluid connection between a first liquid storage tank and the first supply port; and (c) establishing fluid connection between a second liquid storage tank and the second supply port; and (d) operating the rotor pump such that liquid is drawn from the first storage tank by the first rotor element and liquid is drawn from the second storage tank by the second rotor element, and a ratio of a flow rate of liquid being drawn out of the first storage tank to a flow rate of liquid being drawn out of the second storage tank is predefined.

According to a further teaching of the present invention the two inter-engaged rotor elements are implemented such that the inter-engaging projections of one the rotor element are a different size than the inter-engaging projections of another the rotor element such that inter-projection volumes of each of the inter-engaged rotor elements is different, therefore the flow rate of liquid being drawn out of the first storage tank is not equal to the flow rate of liquid being drawn out of the second storage tank.

There is also provided according to the teachings of the present invention a system for sequentially pumping a liquid from multiple storage tanks, the system comprising: (a) a rotor pump having: (i) a pump housing; (ii) at least two inter-engaged rotor elements deployed within the pump housing, each of the rotor elements having a plurality of successively inter-engaging projections, such that a dynamic seal is formed between walls of the pump housing and inter-engaged ones of the projections; (iii) at least two spaced apart liquid supply ports configured to supply liquid to at least a first rotor element of the rotor pump, such that a second of the at least two supply ports is reached by the projections of the rotor element after the projections have passed a first of the supply ports; and (iv) an outlet for flow of liquid out of the pump housing; (b) a first liquid storage tank of variable volume in fluid communication with the first supply port; and (c) a second liquid storage tank of variable volume in fluid communication with the second supply port; wherein when the first storage tank is full, liquid is drawn primarily from the first storage tank and as the liquid content of the first storage tank is depleted so as to no longer supply liquid to the first supply port, liquid is drawn primarily from the second storage tank.

According to a further teaching of the present invention there is also provided at least a third supply port configured to supply liquid to a second of the at least two rotor elements of the rotor pump, the at least a third supply port being in fluid communication with any one from a list including; the first liquid storage tank, the second liquid storage tank, and a third liquid storage tank so as to substantially fill an inter-projection spacing of the second rotor element.

According to a further teaching of the present invention the first supply port supplies liquid to both the first and the second rotor elements, such that the third supply port is reached by projections of the second rotor element after the projections of the second rotor element have passed the first supply port.

According to a further teaching of the present invention there is also provided: (a) at least a fourth liquid supply port configured such that the third supply port is reached by projections of the second rotor element after the projections of the second rotor element have passed the fourth supply port; and (b) a third liquid storage tank of variable volume in fluid communication with the fourth supply port; wherein liquid is pumped by the first rotor element sequentially first from the first storage tank and then from the second storage tank, and liquid is pumped by the second rotor element sequentially first from the third storage tank and then from the second storage tank.

According to a further teaching of the present invention the first inter-projection volume and the second inter-projection volume are different.

There is also provided according to the teachings of the present invention a method for sequentially pumping a liquid from multiple storage tanks, the system comprising: (a) providing a rotor pump having: (i) a pump housing; (ii) at least two inter-engaged rotor elements deployed with in the pump housing, each of the rotor elements having a plurality of successively inter-engaging projections, such that a dynamic seal is formed between walls of the pump housing and inter-engaged ones of the projections; (iii) at least two spaced apart liquid supply ports configured to supply liquid to at least one rotor element of the rotor pump, such that a second of the at least two supply ports is reached by the projections of the rotor element after the projections have passed a first of the supply ports; and (iv)an outlet for flow of liquid out of the pump housing; (b) establishing fluid communication between a first liquid storage tank of variable volume and the first supply port; (c) establishing fluid communication between a second liquid storage tank of variable volume and the second supply port; and (d) operating the rotor pump so as to pump liquid sequentially first from the first storage tank and then from the second storage tank; wherein when the first storage tank is full, liquid is drawn primarily from the first storage tank and as the liquid content of the first storage tank is depleted so as to no longer supply liquid to the first supply port, liquid is drawn primarily from the second storage tank.

According to a further teaching of the present invention there is also provided; (a) the rotor pump is implemented with at least a third supply port configured to supply liquid to a second rotor element of the rotor pump; (b) establishing fluid communication between the at least a third supply port and any one of: the first liquid storage tank; the second liquid storage tank and a third liquid storage tank.

According to a further teaching of the present invention the rotor pump is implemented such that the first supply port supplies liquid to both the first and the second rotor elements, such that the third supply port is reached by projections of the second rotor element after the projections of the second rotor element have passed the first supply port.

According to a further teaching of the present invention there is also provided: (a) implementing the rotor pump so as to include at least a fourth liquid supply port configured such that the third supply port is reached by projections of the second rotor element after the projections of the second rotor element have passed the fourth supply port; and (b) establishing fluid communication between a third liquid storage tank of variable volume and the fourth supply port; wherein liquid is drawn by the first rotor element sequentially first from the first storage tank and then from the second storage tank, and liquid is drawn by the second rotor element sequentially first from the third storage tank and then from the second storage tank.

According to a further teaching of the present invention a flow rate of liquid pumped by one of the at least two rotor elements is not equal to the flow rate of liquid pumped by another of the at least two rotor elements.

BRIEF DESCRIPTION OF THE DRAWINGS

The invention is herein described, by way of example only, with reference to the accompanying drawings, wherein.

DESCRIPTION OF THE PREFERRED EMBODIMENTS

Figure 1:
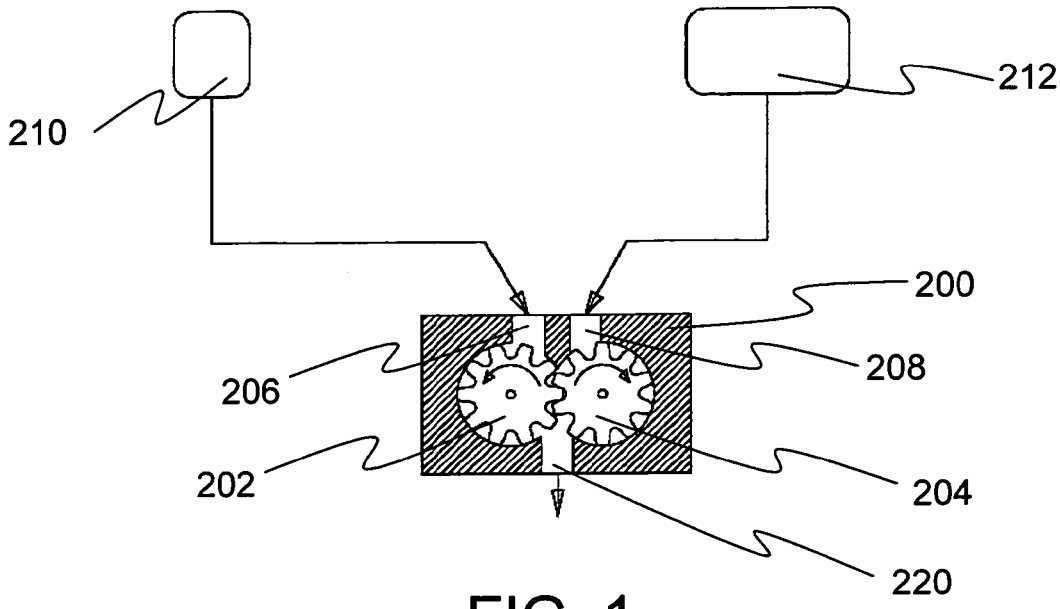
FIG. 1 is a schematic of a first embodiment of a system constructed and operable according to the teachings of the present invention, having a gear pump configured such that each of the gears pumps liquid at the same flow rate and having two supply ports, each supply port supplying liquid to a different one of the gears of the gear pump.

The present invention is a system for sequentially pumping fluid from multiple storage tanks utilizing a single pump having multiple supply ports.

The principles and operation of a system for sequentially pumping fluid from multiple storage tanks utilizing a single pump having multiple supply ports according to the present invention may be better understood with reference to the drawings and the accompanying description.

By way of introduction, it is a feature of certain embodiments of the present invention to provide a method for pumping liquid from each one of multiple storage tanks at a predefined flow rate. In this way, the equilibrium of the platform on which the storage tanks are deployed, such as, but not limited to, an aircraft, may be maintained while the liquid is pumped from the tanks. This will be discussed with regard to FIG. 1.

Another feature of certain embodiments of the present invention is to provide a pump that will pump liquid supplied by supply ports in a rank order dependent on the sequence in which the supply ports are arranged on the pump housing, as will be discussed in detail below with regard to FIGS. 2-7. When a gear pump is used, the arrangement of the supply ports is sequential about the circumference of at least one of the gears in the direction of rotation of the gear. For ease of the discussion herein, the term "gear pump" will be used generically to refer any rotor pump having two or more inter-engaged rotor elements deployed within a pump housing, each of the rotor elements having a plurality of successively inter-engaging projections, such that a dynamic seal is formed between walls of said pump housing and inter-engaged ones of said inter-engaging projections as the rotors rotate. With this in mind, the terms "gear" and "gears" refer to rotor elements and the term "teeth" refers to the inter-engaging projections. It should be noted that while the teeth of the gears of a gear pump are intended for, and do, transfer torque from one gear to another, this is not necessary to fulfill the principles of the present invention. That is, each of the rotors of the present invention may be driven by any appropriate method, and the inter-engaging projections do not need, in all embodiments, to transfer torque from one rotor to the other.

Still another feature of certain embodiments of the present invention is to provide for differential flow rates of liquids pumped from different storage tanks. That is, the flow rate of liquid being pumped by one rotor element of the pump in not equal to the flow rate of another rotor element of the pump. When a gear pump is used, this is accomplished by configuring each of the gears such that the teeth and the space between teeth is different for each of the gears, as will be discussed below with regard to FIGS. 8-11.

Regarding the liquid storage tanks, in systems configured for parallel pumping substantially any liquid storage tank is suitable. In the system configured for sequential pumping, it is preferable that each of the storage tanks be configured so as to have a variable volume, such as, by non-limiting example, the collapsible fuel tanks, typically referred to as "bladder tanks". Another non-limiting example of variable volume fuel tank may be a tank with at least one movable wall such as a piston. It should be noted that the storage tanks of the present invention may be fuel tanks or tanks for the storage of other liquids such as, but not limited to, pesticides and fertilizers, and the pump outlet may be in fluid communication with, for example, spraying equipment.

The system of the present invention is well suited for use with fuel systems in aircraft where balance of the vehicle is important. The system of the present invention provides for the sequential pumping of tanks in any required order, for example drawing from outlying fuel tanks before tanks deployed at or closer to the aircraft's center of balance. However, this need not be the only sequence, and rank order of tanks from which liquid is pumped may vary and is determined based on the requirements of a particular application. The outlying fuel tanks may be located, for example, in each of the wings of an airplane or the tail and forward sections of an airplane or helicopter. Further, if concurrently pumped tanks are of different volumes, but for reasons of aircraft stability, it is preferable that the two tanks be emptied at substantially the same time, the system of the present invention may be configured to pump each of the tanks at a different flow rate.

It should be noted that the principles of the present invention may be equally beneficially applied to water craft designed to operate both below and on the surface of the water.

FIG. 1 illustrates the feature of pumping liquid from each one of multiple storage tanks at a predefined flow rate according to the present invention in its simplest configuration. This first preferred embodiment of the present invention includes a pump 200, which may be implemented as a gear pump, having two supply ports 206 and 208 each configured to supply liquid to one of the gears of the pump, 202 and 204 respectively. The gears then supply to a common liquid outlet 220. In should be noted that while all of the preferred embodiments of the present invention discussed herein share the feature of a single common outlet, this is not intended as a limitation to the present invention, and implementation of a pump with multiple outlets is within the intention of the present invention. Supply port 206 is in fluid communication with liquid storage tank 210, and supply port 208 is in fluid communication with liquid storage tank 212. When both of the storage tanks are full, the platform on which the tanks are deployed, such as, but no limited to, a helicopter, is stable. Random depletion of the storage tanks may cause imbalance and a loss of stability. The pump 200 is configured such that liquid is drawn from each of the storage tanks at substantially the same flow rate. Therefore, the change in the volume of liquid in, and thus the weight of, each of the storage tanks changes at substantially the same rate substantially independent of the fluid flow impedance of the tanks, thereby maintaining the balance of the helicopter. In some applications it may be preferable to deplete the liquid in the storage tanks at predetermined different flow rates, this will be discussed below with regard to FIG. 8.

Figure 2:
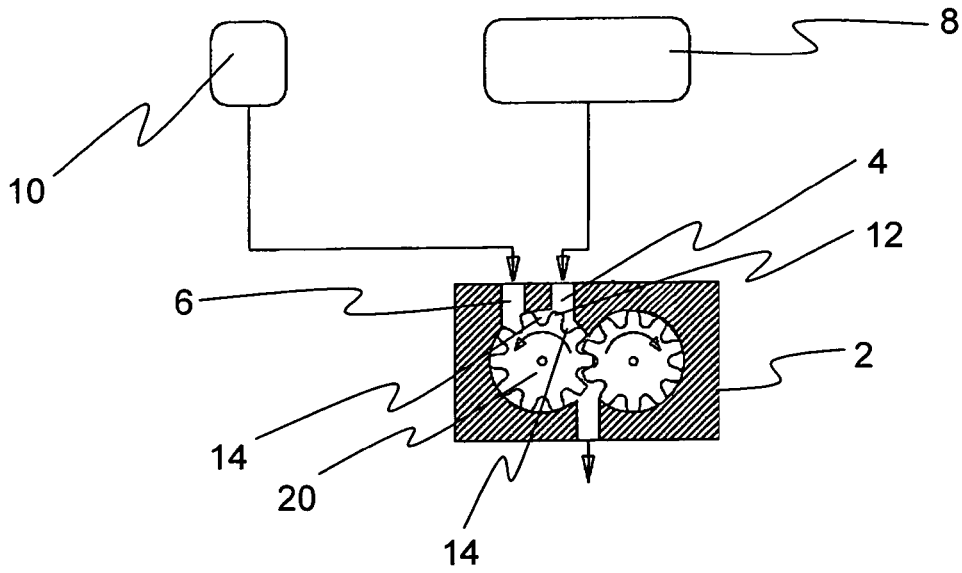
FIG. 2 is a schematic of a second embodiment of a system constructed and operable according to the teachings of the present invention, configured with a gear pump having two supply ports that supply liquid to one gear of the gear pump.

Referring now to the feature of sequential supply ports, FIG. 2 schematically illustrates a second preferred system of the present invention. Gear pump 2 has two supply ports 4 and 6. Supply port 4 receives liquid from storage tank 8 and supply port 6 receives liquid from storage tank 10. As gear 20 rotates, the teeth 12 pass the supply ports in sequence. That is, the teeth 12 of gear 20 first pass supply port 4 and subsequently pass supply port 6. As the gear 20 rotates, each successive inter-tooth volume 14 of the gear is filled with liquid supplied by supply port 4. The term "inter-tooth volume", and on a generic level the term "inter-projection volume", as used herein refers to the space between adjacent gear teeth, or inter-engaging projections, enclosed by the walls of the pump housing. In this embodiment, as in substantially all embodiments of the present invention, it is preferably for the distance between each of the successive supply ports be such that the fluid communication between the inter-tooth volume and each supply port be terminated before fluid communication is established with the next successive supply port. Therefore, when the now filled inter-tooth volume 14 reaches, that is, comes into fluid communication with, supply port 6 substantially no liquid is introduced into the inter-tooth volume 14. Once the amount of liquid remaining in storage tank 8 is depleted to a level that the inter-tooth volume 14 is no longer filled by supply port 4, liquid will begin to be introduced to the inter-volume 14 by supply port 6, thereby pumping liquid from storage tank 10. That is, when the storage tank 8 contains drawable liquid, liquid is drawn primarily from storage tank 8, and as the liquid content of storage tank 8 is depleted so as to no longer supply liquid to supply port 4, liquid is drawn primarily from storage tank 10. It should be noted that the size of each storage tank does not effect the operation of the system. That is, although in FIG. 2 tank 8 is illustrated as larger than tank 10, the two tanks could be of equal volume or tank 10 could be the larger of the two. This is true also for all of the systems of the present invention discussed herein. That is, it is the sequential order of the supply ports rather than the size of the tank that affects the pumping order.

Figure 3:
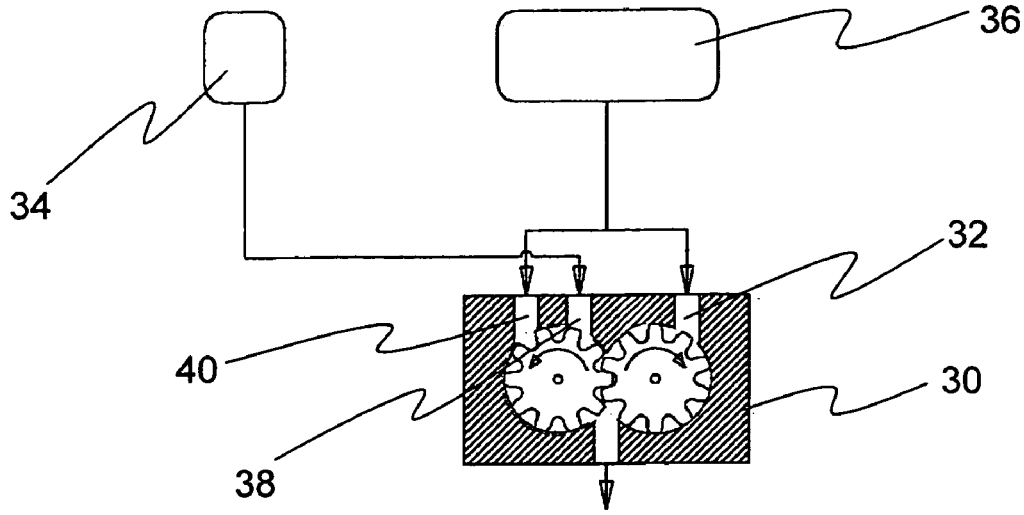
FIG. 3 is a schematic of a third embodiment of a system constructed and operable according to the teachings of the present invention, configured with a gear pump having three supply ports.

The third preferred embodiment of the present invention illustrated in FIG. 3 is configured with a gear pump 30 having a third supply 32 port in fluid communication with tank 36 such that liquid is pumped concurrently from tank 34, through supply port 38, and tank 36, through supply port 32, until liquid is no longer being supplied to supply port 38 from storage tank 34. At such time, liquid is pumped from storage tank 36 through both supply ports 30 and 38. With the pump operating, substantially continuous pumping of liquid and a substantially constant flow rate is ensured as long as liquid is being supplied.

Figure 4:
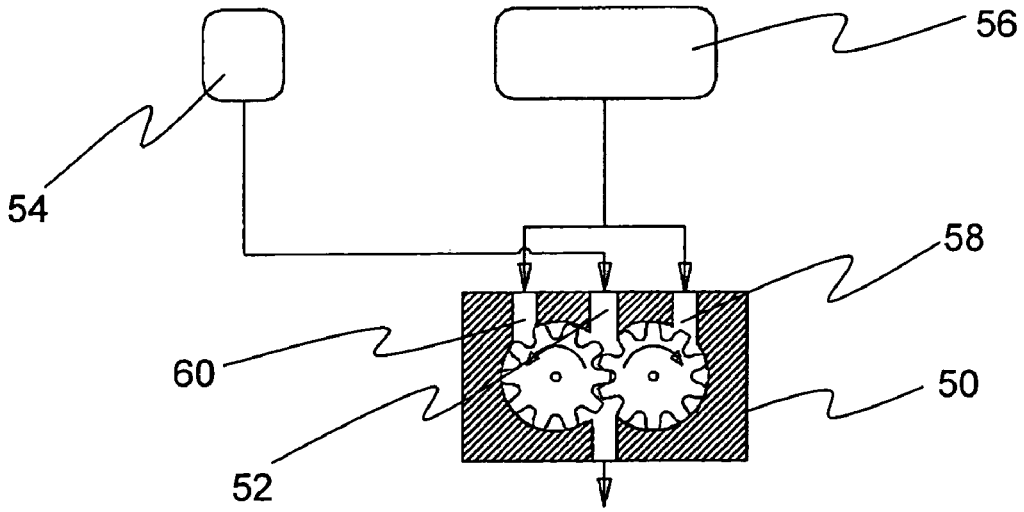
FIG. 4 is a schematic of a fourth embodiment of the present invention, which is an alternative of a system configured with a gear pump having three supply ports.

FIG. 4 illustrates a fourth preferred embodiment that is a variant embodiment of a three supply port system of the present invention. Here, liquid from storage tank 54 is supplied to both gears of the gear pump 50 through supply port 52. Once liquid is no longer being supplied through supply port 52, liquid begins flowing from storage tank 56 through supply ports 58 and 60.

Figure 5:
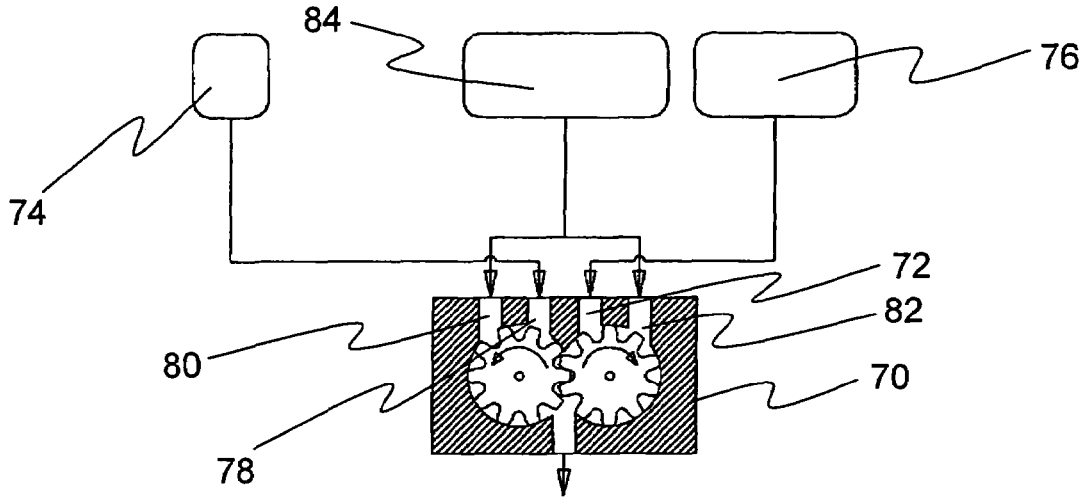
FIG. 5 is a schematic of a fifth embodiment of a system constructed and operable according to the teachings of the present invention, configured with a gear pump having four supply ports.

The fifth preferred embodiment of FIG. 5 includes a gear pump 70 having four supply ports and three liquid storage tanks 74, 76 and 84. Storage tank 74 is in fluid communication with supply port 78; storage tank 76 is in fluid communication with supply port 72; and storage tank 84 is in fluid communication ports 80 and 82. When operated, the pump will first pump liquid supplied to ports 72 and 78 from storage tanks 76 and 74 respectively. When liquid is no longer supplied to supply port 72, liquid will begin to flow through supply port 82, thereby drawing liquid from storage tank 84. Similarly, when liquid is no longer supplied to supply port 78, liquid will begin to flow through supply port 80, thereby drawing liquid from storage tank 84. In this embodiment, as in some of the other embodiments, of the present invention, substantially continuous pumping of liquid and a substantially constant flow rate is ensured as long as liquid is being supplied.

Figure 6:
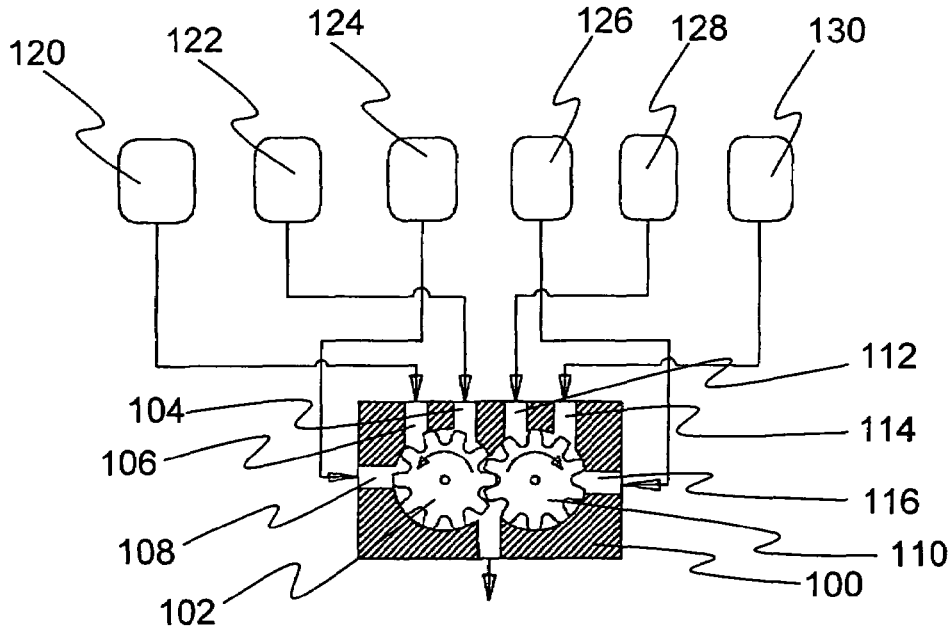
FIG. 6 is a schematic of a sixth embodiment of a system constructed and operable according to the teachings of the present invention, configured with a plurality of liquid storage tanks and a gear pump having a number of supply ports equal to the number of storage tanks.

It will be appreciated that the number of sequential supply ports of the present invention is limited only by practicality as determined by the size of the rotor pump used. To illustrate this point, FIG. 6 shows a sixth preferred embodiment of a system of the present invention with a gear pump 100 having six supply ports, three supply ports associated with each of the two gears of the gear pump, and six storage tanks each in fluid communication with a different supply port. Pump gear 102 is associated with supply port 104, which is in fluid communication with storage tank 122; supply port 106, which is in fluid communication with storage tank 120; and supply port 108, which is in fluid communication with storage tank 124. As a result of this sequence of supply ports, liquid is drawn sequentially first from storage tank 122, then from storage tank 120 and then from tank 124. Similarly, pump gear 110 is associated with supply port 112, which is in fluid communication with storage tank 128; supply port 114, which is in fluid communication with storage tank 130; and supply port 116, which is in fluid communication with storage tank 126. As a result of this sequence of supply ports, liquid is drawn sequentially first from storage tank 128, then from storage tank 130 and then from tank 126.

Figure 7:
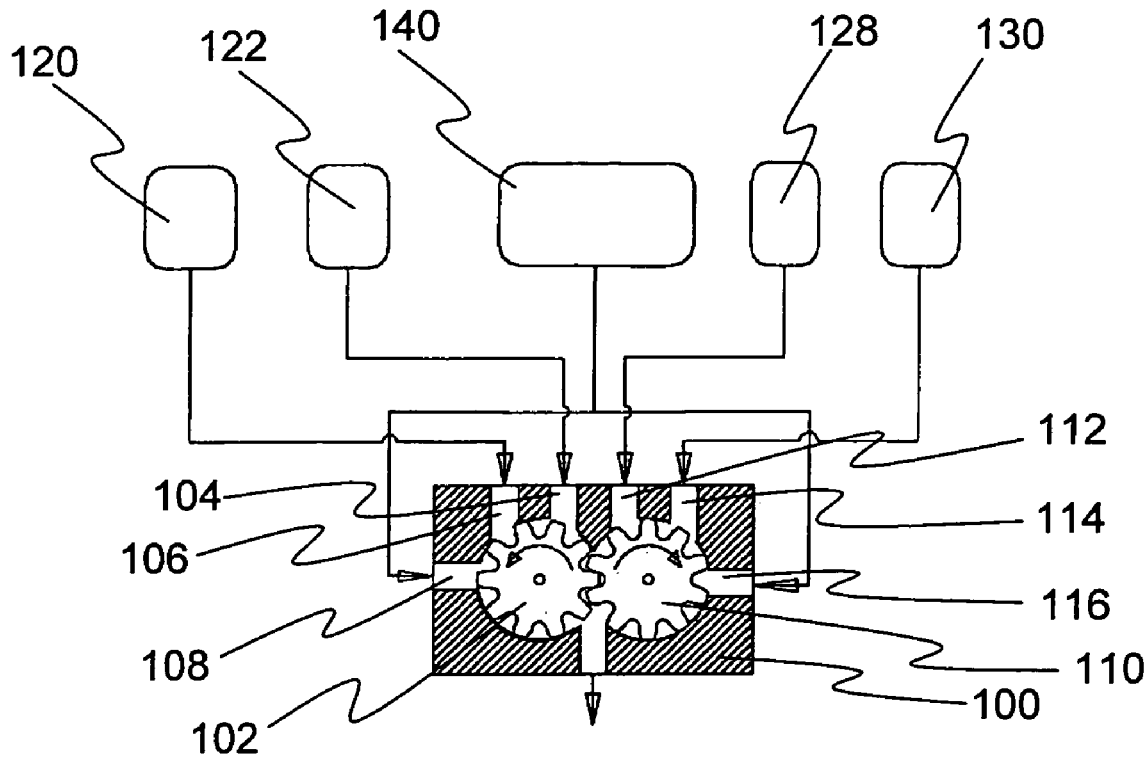
FIG. 7 is a schematic of a seventh embodiment of the present invention, which is an alternative of the system of FIG. 6, the system shown here is configured with a plurality of liquid storage tanks and a gear pump having a number of supply ports such that the number of supply ports is one less than the number of storage tanks.

A seventh preferred embodiment, which is a variant of the sixth preferred embodiment of FIG. 6, is illustrated in FIG. 7. Here, supply ports 108 and 116 are both in fluid communication with the same storage tank 140. In this configuration, liquid will be pumped by pump gear 102 sequentially from storage tank 122 and 120 and then liquid will be pumped from storage tank 140. Similarly, liquid will be pumped by pump gear 110 sequentially from storage tank 128 and 130 and then liquid will be pumped from storage tank 140. Here too, substantially continuous pumping of liquid and a substantially constant flow rate is ensured as long as liquid is being supplied without changing the speed of the pump.

Figure 8:
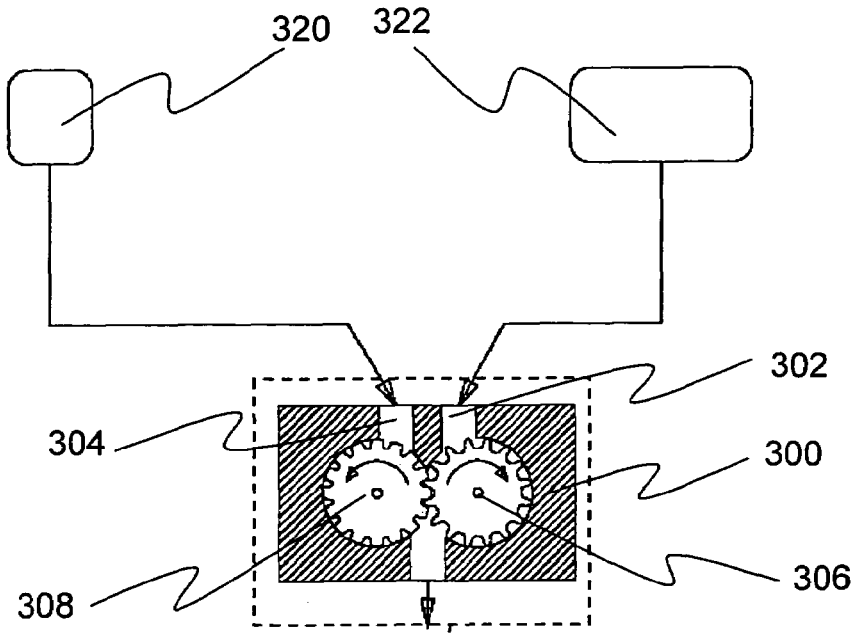
FIG. 8 is a schematic of an eighth embodiment of the system of the present invention constructed and operable according to the teachings of the present invention having a gear pump with two supply ports and configured such that each of the gears pumps liquid at a different flow rate, each supply port supplying liquid to a different one gears of the gear pump.
Figure 9:
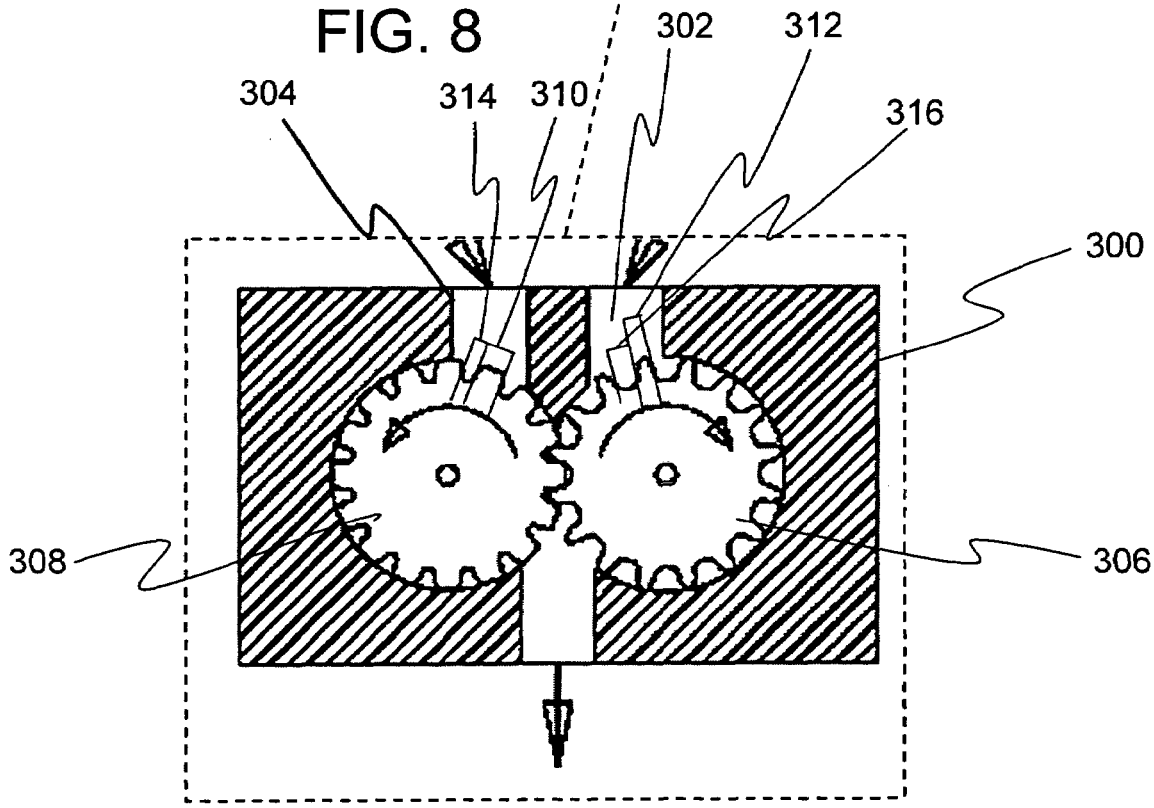
FIG. 9 is a detail of the pump of FIG. 8.

Regarding the feature of providing differential flow rates of liquids pumped from different storage tanks, the eighth preferred embodiment of the present invention, illustrated in FIG. 8, includes a pump, which is shown in detail in FIG. 9. Also included in the system of this embodiment are two liquid storage tanks 320 and 322. In order to pump liquid supplied to supply ports 302 and 304 at different flow rates, gears 306 and 308 have different sized gear teeth. That is, the circumferential length 310 of the teeth, or inter-engaging projections, of gear, or rotor element, 308 is longer than the circumferential length 312 of the teeth of gear 306. Likewise, the circumferential length of the inter-tooth spacing 314 and 316 between adjacent teeth of each of the gears corresponds to the circumferential length of the teeth of the other gear, or rotor element. That is, the inter-tooth spacing of the teeth of each gear is a distance that will accommodate the corresponding teeth of the other gear. Thusly configured, the inter-tooth volume of each of the gears is different; therefore, liquid is pumped by each gear at a different flow rate. As illustrated here, liquid is pumped out of storage tank 322 by gear 306 at a higher flow rate than liquid is pumped out of storage tank 320 by gear 308. The flow rate ratio is determined by the size of the inter-tooth spacing of each of the gears. Although pumping at a flow rate ratio that will empty both of the storage tanks at substantially the same time may be preferred, substantially any flow rate ratio may be established according to the requirements of a particular application such that either of the tanks may be emptied before the other.

Figure 10:
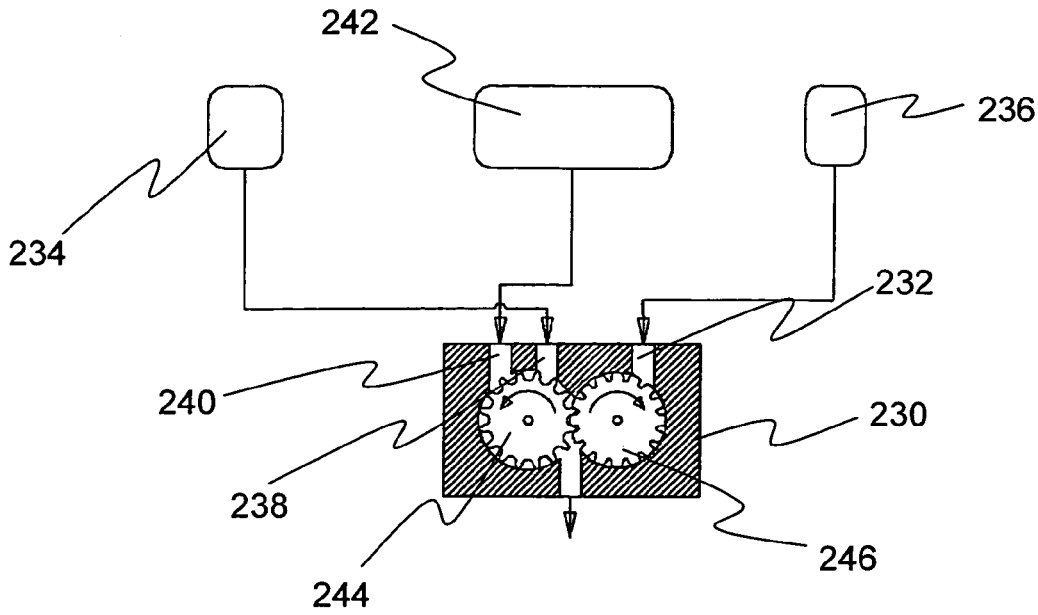
FIG. 10 is a schematic of a ninth embodiment of a system constructed and operable according to the teachings of the present invention have a gear pump with three supply ports and three liquid storage tanks.

A ninth preferred embodiment of a system of the present invention, as illustrated in FIG. 10, is configured with a gear pump 230 having two supply ports 238 and 240, which supply liquid to gear 244 of the gear pump 230, and a third supply port 232, which supplies liquid to the other gear 246 of the gear pump 230. As gear 244 rotates, the teeth pass, and establish fluid communication with, each of the supply ports 238 and 240 in sequence, first supply port 238 and then supply port 240. Since the teeth of the two gears 244 and 246 are of different sizes, the flow rate of liquid pumped by gear 244 is higher than the flow rate of liquid being pumped by gear 246. Supply port 232 is in fluid communication with storage tank 236, supply port 238 is in fluid communication with storage tank 234 and supply port 24 is in fluid communication with storage tank 242. When the pump is operated, liquid is drawn concurrently from tank 234, through supply port 238, and tank 236, through supply port 232. When storage tank 234 is full, liquid is drawn by gear 244 primarily from storage tank 234, and as the liquid content of storage tank 234 is depleted so as to no longer supply liquid to said first supply port, liquid is drawn by gear 244 primarily from storage tank 242 through supply port 240. Configured thusly, tank 234 may be emptied and liquid will begin to be pumped from tank 242 before tank 236 is emptied. The flow rate ratio of the gears may be set such that tanks 242 and 236 empty at substantially the same time or one may empty before the other.

Figure 11:
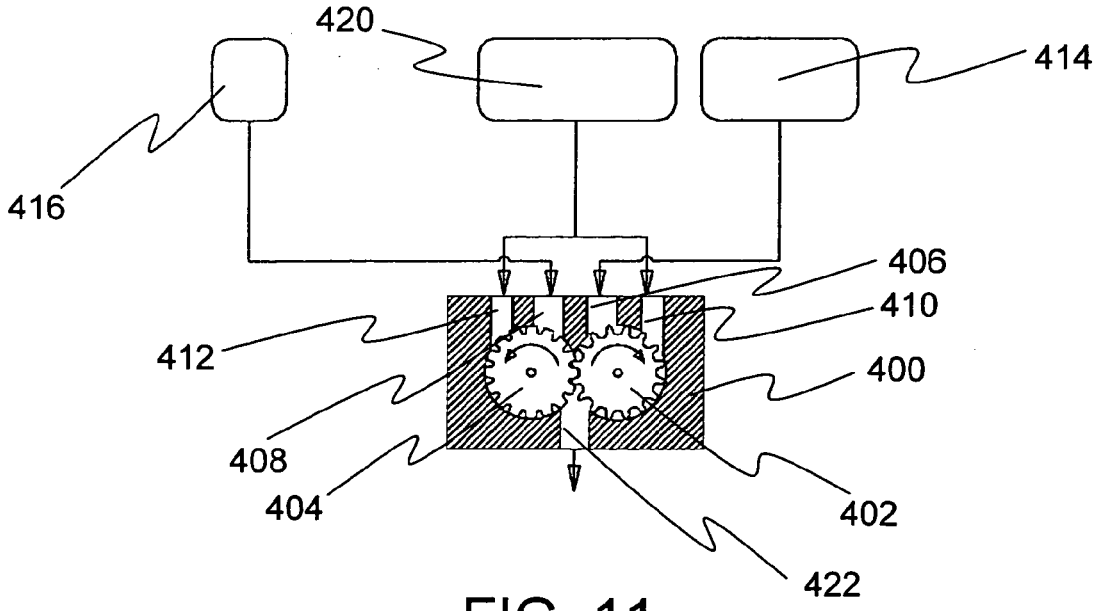
FIG. 11 is a schematic of a tenth embodiment of a system constructed and operable according to the teachings of the present invention having a gear pump with supply ports configured such that each of the gears pumps liquid at a different flow rate and three liquid storage tanks.

The tenth preferred embodiment of the present invention as shown in FIG. 11, illustrates a system combining the three features of the present invention mentioned above, namely sequential pumping from multiple storage tanks, at different flow rates so as to maintain the equilibrium of, for example, an aircraft. The stability requirements of the aircraft necessitate the substantially simultaneous emptying of liquid, in the case fuel, storage tanks 414 and 416 so as to empty at substantially the same time, and substantially only then to pump fuel from storage tank 420. Therefore, the gears 402 and 404 have different inter-tooth spacing with a flow rate ratio such that storage tanks 414 and 416 will empty at substantially the same time. When fuel is no longer supplied to supply ports 406 and 408, fuel will begin to flow through supply ports 410 and 412, thereby pumping fuel from storage tank 420. By supplying fuel to both gears 402 and 404 of the pump, the flow rate of fuel flowing through the pump outlet 422 to the engine will remain substantially constant even though fuel is now being pumped from a single fuel tank without changing the speed of the pump. As previously mentioned, in this embodiment, as in some other embodiments herein described, substantially continuous pumping of liquid and a substantially constant flow rate is ensured as long as liquid is being supplied.

It will be appreciated that the above descriptions are intended only to serve as examples and that many other embodiments are possible within the spirit and the scope of the present invention.

What is claimed is:

1. A system for sequentially pumping a liquid from multiple storage tanks, the system comprising:

a) a rotor pump having:

i) a pump housing;

ii) at least two inter-engaged rotor elements deployed within said pump housing, each of said rotor elements having a plurality of successively inter-engaging projections, such that a dynamic seal is formed between walls of said pump housing and inter-engaged ones of said projections;

iii) at least two spaced apart liquid supply ports configured to supply liquid to at least a first rotor element of said rotor pump, such that a second of said at least two supply ports is reached by said projections of said rotor element after said projections have passed a first of said supply ports; and iv) an outlet for flow of liquid out of said pump housing;

b) a first liquid storage tank of variable volume in fluid communication with said first supply port; and c) a second liquid storage tank of variable volume in fluid communication with said second supply port;

wherein when said first storage tank is full, liquid is drawn primarily from said first storage tank and as the liquid of said first storage tank is depleted so as to no longer supply the liquid to said first supply port, liquid is drawn primarily from said second storage tank.

2. The system of claim 1, further including at least a third supply port configured to supply liquid to a second of said at least two rotor elements of said rotor pump, said at least a third supply port being in fluid communication with any one from a list including; said first liquid storage tank, said second liquid storage tank, and a third liquid storage tank so as to substantially fill an inter-projection spacing of said second rotor element.

3. The system of claim 2, wherein said first supply port supplies liquid to both said first and said second rotor elements, such that said third supply port is reached by projections of said second rotor element after said projections of said second rotor element have passed said first supply port.

4. The system of claim 2, wherein said first inter-projection volume and said second inter-projection volume are different.

5. A method for sequentially pumping a liquid from multiple storage tanks, the system comprising:

a) providing a rotor pump having:

i) a pump housing;

ii) at least two inter-engaged rotor elements deployed with in said pump housing, each of said rotor elements having a plurality of successively inter-engaging projections, such that a dynamic seal is formed between walls of said pump housing and inter-engaged ones of said projections;

iii) at least two spaced apart liquid supply ports configured to supply liquid to at least one rotor element of said rotor pump, such that a second of said at least two supply ports is reached by said projections of said rotor element after said projections have passed a first of said supply ports; and iv) an outlet for flow of liquid out of said pump housing;

b) establishing fluid communication between a first liquid storage tank of variable volume and said first supply port;

c) establishing fluid communication between a second liquid storage tank of variable volume and said second supply port; and d) operating said rotor pump so as to pump liquid sequentially first from said first storage tank and then from said second storage tank;

wherein when said first storage tank is full, said liquid is drawn primarily from said first storage tank and as the liquid of said first storage tank is depleted so as to no longer supply the liquid to said first supply port, the liquid is drawn primarily from said second storage tank.

6. The method of claim 5, further comprising;

a) said rotor pump is implemented with at least a third supply port configured to supply liquid to a second rotor element of said rotor pump;

b) establishing fluid communication between said at least a third supply port and any one of: said first liquid storage tank; said second liquid storage tank and a third liquid storage tank.

7. The method of claim 6, wherein said rotor pump is implemented such that said first supply port supplies liquid to both said first and said second rotor elements, such that said third supply port is reached by projections of said second rotor element after said projections of said second rotor element have passed said first supply port.

8. The method of claim 6, wherein a flow rate of liquid pumped by one of said at least two rotor elements is not equal to the flow rate of liquid pumped by another of said at least two rotor elements.

* * * * *

UNITED STATES PATENT AND TRADEMARK OFFICE

CERTIFICATE OF CORRECTION

PATENT NO. : 7,395,948 B2
APPLICATION NO. : 10/938656
DATED : July 8, 2008
INVENTOR(S) : Meir Kogan It is certified that error appears in the above-identified patent and that said Letters Patent is hereby corrected as shown below:

Title Page (73)

The Assignee address should be corrected as follows:
change "Maifa" to --Haifa--

Signed and Sealed this

Second Day of September, 2008

JON W. DUDAS
*Director of the United States Patent and Trademark Office*